US005832839A

United States Patent [19]

Forbes

[11] Patent Number: 5,832,839

[45] Date of Patent: Nov. 10, 1998

[54] CURVED FLANGE SIDEWALL CONSTRUCTION FOR RAILCAR END STRUCTURE

[75] Inventor: James Wilfred Forbes, Waterloo, Canada

[73] Assignee: National Steel Car, Canada

[21] Appl. No.: 641,366

[22] Filed: Apr. 30, 1996

[51] Int. Cl.[6] ..... B61D 3/00

[52] U.S. Cl. ..... 105/404; 105/409; 105/410

[58] Field of Search ..... 105/355, 396, 105/404, 407, 411, 413, 414, 416, 419, 420, 421

[56] References Cited

U.S. PATENT DOCUMENTS

| | | | |
|---|---|---|---|
| 2,003,138 | 5/1935 | Fries | 105/420 |
| 4,805,539 | 2/1989 | Ferris et al. | 105/355 |
| 4,889,055 | 12/1989 | Jamrozy et al. | 105/355 |
| 4,949,646 | 8/1990 | Jamrozy et al. | 105/411 |
| 5,423,269 | 6/1995 | Saxton et al. | 105/355 |
| 5,465,670 | 11/1995 | Butcher | 105/355 |
| 5,564,341 | 10/1996 | Martin | 105/355 |

FOREIGN PATENT DOCUMENTS

| | | |
|---|---|---|
| 1235335 | 4/1988 | Canada . |
| 2094194 | 4/1993 | Canada . |

*Primary Examiner*—Mark T. Le
*Attorney, Agent, or Firm*—Oldham & Oldham Co., LPA

[57] ABSTRACT

An end structure for a railroad freight car having longitudinally extending and spaced apart side structures. Each of the side structures provide top and bottom longitudinally disposed structural members which are spaced apart and connected to the end structure. Each of the top and bottom members have a terminal end portion. The bottom member is shorter in length than the top member to define an overhanging relationship between the top and bottom members in an area of the end structure outboard of the terminal end portion of the bottom member. The end structure comprises a planar sidewall extending between the top and bottom members. The sidewall has top and bottom edges. The top edge is joined to the top structural member. The bottom edge consists of an inboard straightedge portion, an intermediate curved portion and an outboard straightedge portion. The inboard portion is joined along its length to the bottom structural member. The curved portion extends upwardly from the inboard portion adjacent the terminal end portion of the bottom structural member and merges with the outboard portion of the bottom edge of the sidewall. The curved portion defines a curved edge having a positive slope of constantly decreasing value when measured from the inboard portion to the outboard portion. The end structure further comprises a one-piece curved flange connected to the terminal end of the bottom structural member and to the curved portion of the bottom edge of the sidewall along the entire length thereof. The sidewall consists of a single web in the area of the end structure outboard of the terminal end portion of the bottom structural member and inboard of the terminal end portion of the top structural member. The continuous curvature of the flange is designed to reduce stress risers associated with geometric discontinuity, to enhance fatigue resistance of the flange itself and the end structure, and to facilitate access by an operator to a truck supporting the end structure.

13 Claims, 6 Drawing Sheets

CURVED FLANGE SIDEWALL CONSTRUCTION FOR RAILCAR END STRUCTURE

FIELD OF INVENTION

This invention pertains generally to a railroad freight car for carrying intermodal cargo containers. In particular, this invention relates to a curved flange sidewall construction for an end structure of a railroad freight car.

BACKGROUND OF THE INVENTION

The prior art has provided a variety of freight cars adapted to carry intermodal cargo containers, and these types of freight cars are known to some skilled in this art as container cars. One type of container car in use is referred to as a well car since it has a container receiving well portion or well space located between car railway trucks provided at each end of the car.

A well car generally has a longitudinally extending load bearing body formed by spaced apart side structures, which may comprise top side chords and bottom side chords, and by opposing end structures. The car body is mounted at its ends on trucks which run on the railway tracks. The side structures and the end structures define the well portion of the car body. The body of the car is generally at as low a height as possible so the car provides a low profile so that the car when loaded with containers can clear bridges, tunnels and the like safely. Accordingly, the bottom side chords are generally relatively close to the railway tracks.

During operation, the railway trucks supporting each end of the car body bear significant loads and undergo severe stresses which lead to equipment wear. As a result, the railway trucks require frequent inspection and maintenance. For example, the wheels and brake shoes of the trucks must frequently be examined for excessive wear which with prior art designs require maintenance personnel to crawl under the end structure of the car body. This is not only awkward for such personnel, but is also a time-consuming and inefficient procedure. Thus, there is a need for a well car having an end structure which enables a user to easily inspect the associated railway truck and to easily access it for maintenance and repair purposes.

In addition, the increasing use of automated infrared detectors along railroad tracks to monitor overheating in the railway truck due to frictional forces makes it desirable to have a railway car body having an open end structure in the vicinity of the railway truck which further exposes the truck, thus facilitating infrared detection of overheating therein.

As the end structure of the car is under significant loading and stress, it should also have good fatigue resistance and be of sufficient strength to safely withstand the static and dynamic forces acting upon it during use and operation of the car. The end structure design should also seek to minimize or avoid any unnecessary stress risers or structural discontinuities in the connections and surfaces thereof.

Furthermore, the end structure should consist of the minimum number of parts possible in order to simplify assembly thereof, reduce manufacturing costs and reduce the number of different parts a manufacturer must stock and track in inventory.

Various sidewalls for end structures heretofore disclosed are exemplified in the following patents and published application. U.S. Pat. No. 5,465,670 issued on Nov. 14, 1995 to Butcher shows a well car having a geometrically discontinuous sidewall construction at each terminal end of the railcar comprising (i) an outboard horizontal, straightedge bottom edge portion; (ii) an intermediate downwardly sloping straightedge bottom edge portion; and (iii) an inboard generally horizontal, straightedge bottom edge portion. The third inboard straightedge portion is parallel to, but disposed at a lower height than the outboard straightedge portion. The upper end of the intermediate sloping portion connects to the inboard terminal end of the outboard straightedge portion at a corner; the lower end of the intermediate sloping portion connects to the outboard terminal end of the inboard straightedge. A one-piece flange is joined to the inboard and outboard straightedge portions of the sidewall. A diagonal reinforcing member for reinforcing the connection of flange to the sidewall is provided at the comer.

Canadian Pat. No. 1,235,335 issued to Gunderson Inc. on Apr. 19, 1988, and Canadian Application No. 2,094,194 filed by Gunderson, Inc. on Apr. 16, 1993 show sidewall structures which are also geometrically discontinuous and which have a sloped intermediate portion connecting an inboard generally horizontal, straightedge portion to an outboard generally horizontal, straightedge portion.

While the sidewall constructions in the referenced patents and application have worked reasonably well, the geometric discontinuity between the outboard straightedge portion and the intermediate sloped portion may introduce stress risers in the sidewall constructions.

SUMMARY OF THE INVENTION

According to a broad aspect of the present invention, there is provided an end structure for a railroad freight car of the type having longitudinally extending and spaced apart side structures. Each of the side structures provide top and bottom longitudinally disposed structural members which are spaced apart and which are connected to the end structure. Each of the top and bottom structural members have a terminal end portion. The bottom structural member is shorter in length than the top structural member to define an overhanging relationship between the top and bottom structural members in an area of the end structure outboard of the terminal end portion of the bottom structural member. The end structure comprises a planar sidewall extending substantially vertically between the top and bottom structural members. The sidewall has (i) a top edge; and (ii) a bottom edge. The top edge is joined to the top structural member. The bottom edge consists of an inboard straightedge portion, an intermediate curved portion and an outboard straightedge portion. The inboard straightedge portion is joined along its length to the bottom structural member. The intermediate curved portion extends upwardly from the inboard straightedge portion adjacent the terminal end portion of the bottom structural member and merges with the outboard straightedge portion of the bottom edge of the sidewall. The intermediate curved portion defines a curved edge having a slope of constantly decreasing absolute value when measured from the inboard straightedge portion to the outboard straightedge portion. The end structure further comprises a one-piece curved flange connected to the terminal end of the bottom structural member and to the intermediate curved portion of the bottom edge of the planar sidewall along the entire length thereof. The planar sidewall consists of a single web in the area of the end structure outboard of the terminal end portion of the bottom structural member and inboard of the terminal end portion of the top structural member.

With reference to preferred embodiments of the present invention, the end structure is provided in a railroad freight car having a well portion for receiving a cargo container. The one-piece curved flange is connected not only to the intermediate curved portion of the bottom edge, but also to the outboard straightedge portion along the entire length of that portion. The connection of the curved flange to the bottom edge of the planar sidewall, in cross-section, has a substantially inverted T-shaped profile.

The end structure of the preferred embodiment further comprises an inboard bulkhead extending between the side structures and connected to the respective sidewalls of the end structure. In addition, the end structure includes a transversely disposed structural member, which is an upper bolster which is connected to the top structural members of the side structures.

The end structure further comprises a horizontally disposed shear plate. The shear plate has an upper surface to which the upper bolster is attached, a lower surface from which a lower stub bolster depends, and an inboard terminal edge from which the bulkhead depends. The shear plate and bulkhead each extend between the side structures to connect to the respective sidewalls thereof.

The side structure of the end structure provides a generally vertically disposed web located adjacent each bulkhead, which is co-planar therewith. The web is connected to the sidewall along an inwardly facing longitudinal edge of the web. A generally vertically disposed flange member is connected to the outwardly facing longitudinal edge of the web. The flange member has one terminal end which is connected to the top structural member of the side structure. In the preferred embodiment, the top and bottom structural members of the side structures are each elongate, straightline chords.

BRIEF DESCRIPTION OF THE DRAWINGS

For purposes of illustration, but not of limitation, preferred embodiments of the present invention will next be described with reference to the following drawings, in which:

FIG 3-B is a detailed side sectional view of the railroad car as depicted in FIG. 3-1, taken along view lines 3—3 in FIG. 1;

DETAILED DESCRIPTION OF THE DRAWING

Figure 1:
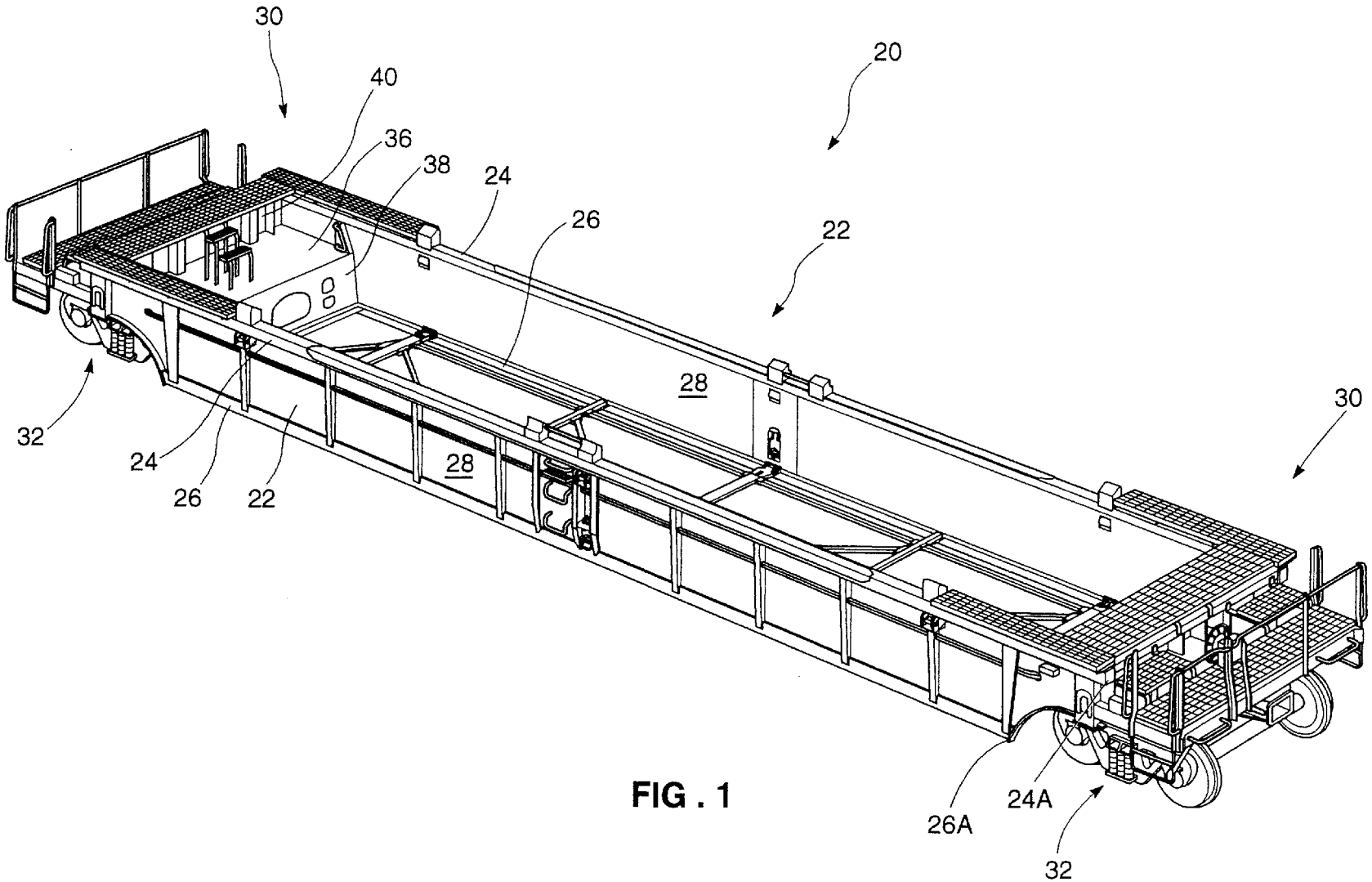
FIG. 1 is a perspective view of the railroad car of the present invention.

A railroad freight car for transporting intermodal cargo containers is illustrated in FIG. 1 generally as 20. The car has a longitudinally extending load-bearing frame structure formed by spaced apart side structures 22 and by opposing end structures 30. Each side structure 22 comprises a longitudinally disposed top side chord 24, a longitudinally bottom disposed side chord 26 and a side wall 28. The frame structure is mounted at its ends on conventional railway trucks 32 which run on railway tracks. The side structures 22, end structures 30 and a floor structure of conventional design (or such as that disclosed in the previously mentioned Canadian Pat. No. 5,465,670 ) define a well for receiving intermodal cargo containers.

Figure 2:
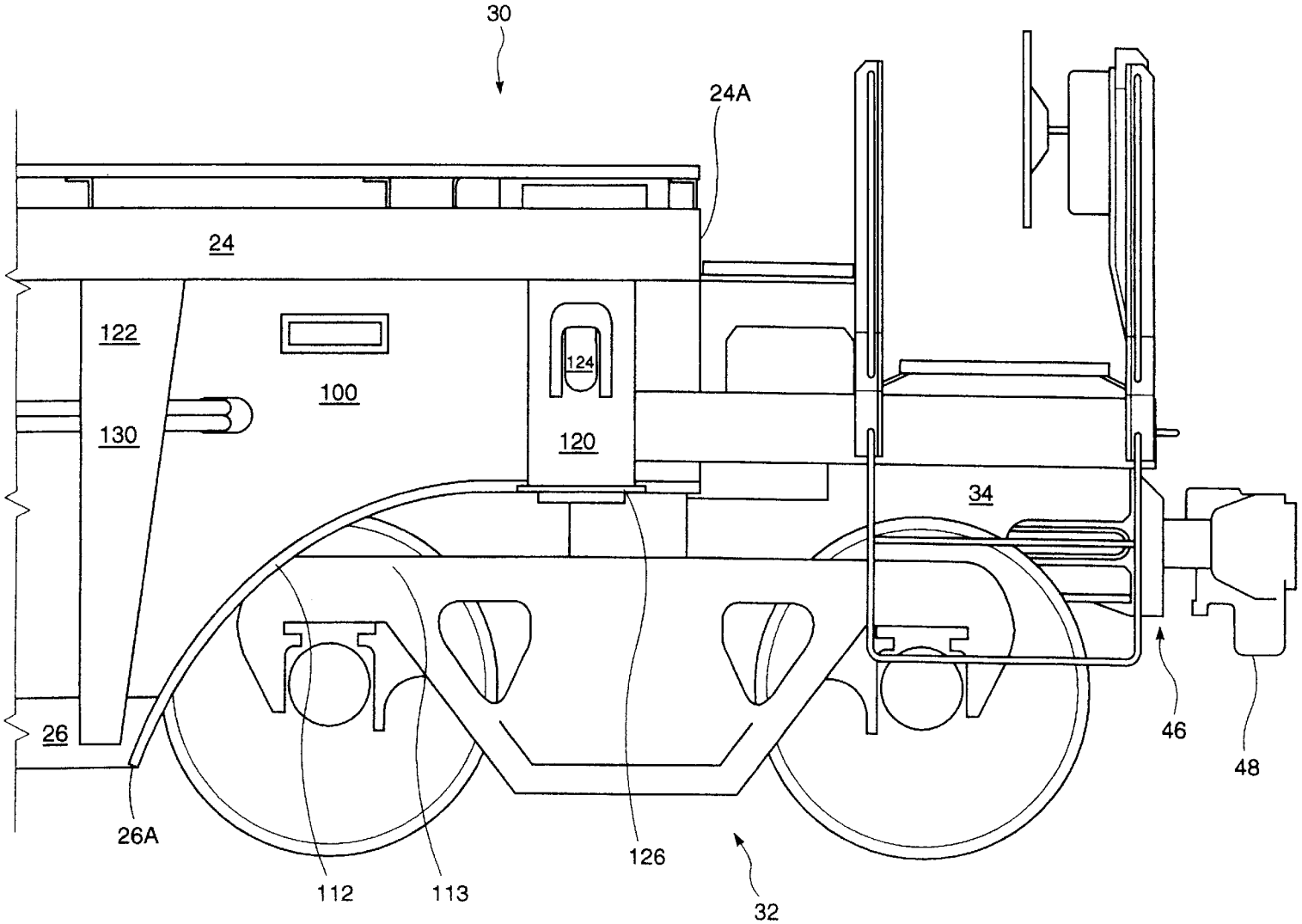
FIG. 2 is a detailed side elevational view of one end of the railroad car of FIG. 1 shown with a coupler.
Figure 3A:
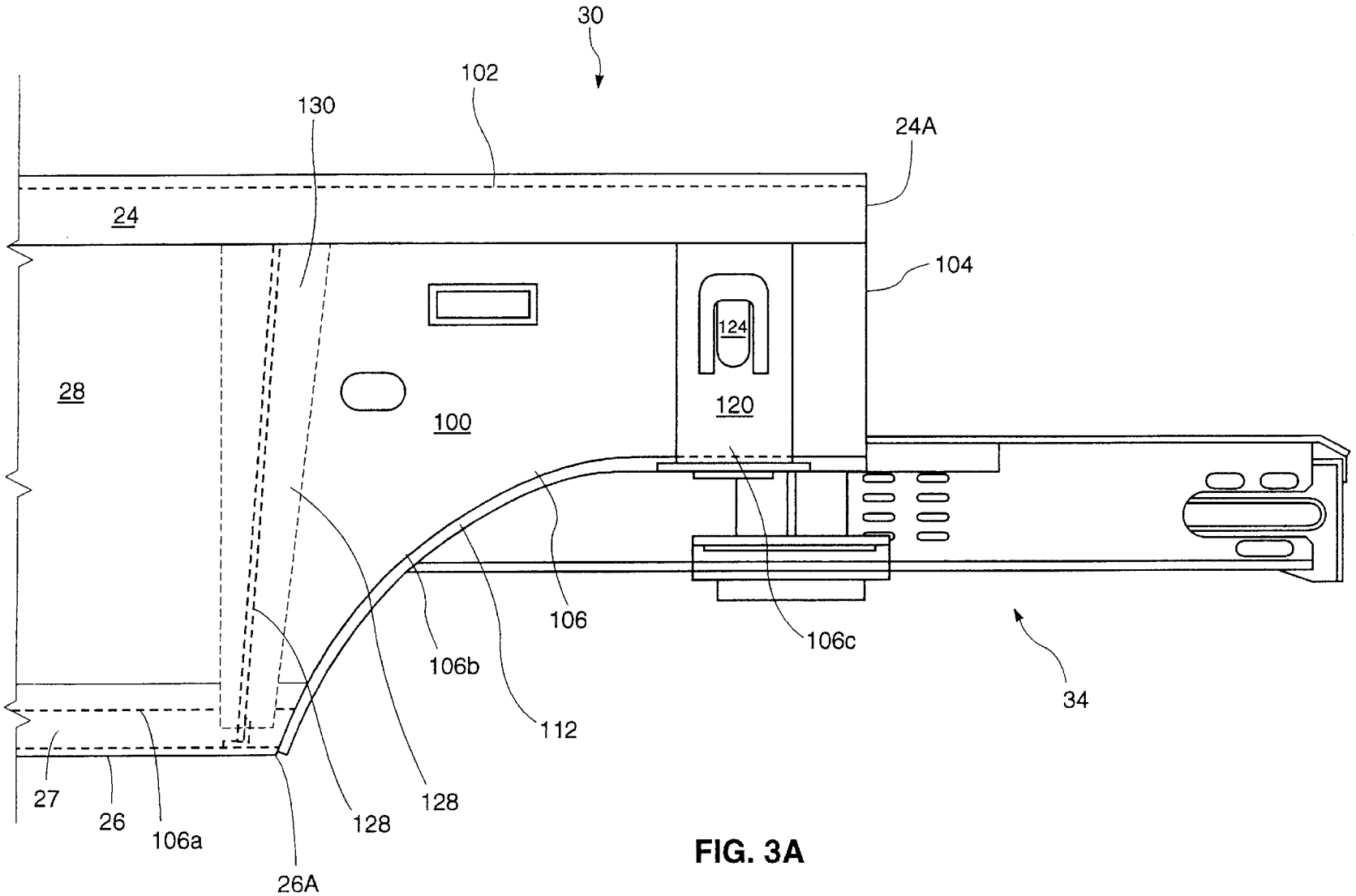
FIG. 3-A is a detailed side elevational view of one end of the railroad car similar t o the view of FIG. 2, shown (i) without the railings and platform and step arrangement; and (ii) without the railway truck for greater clarity.
Figure 3B:
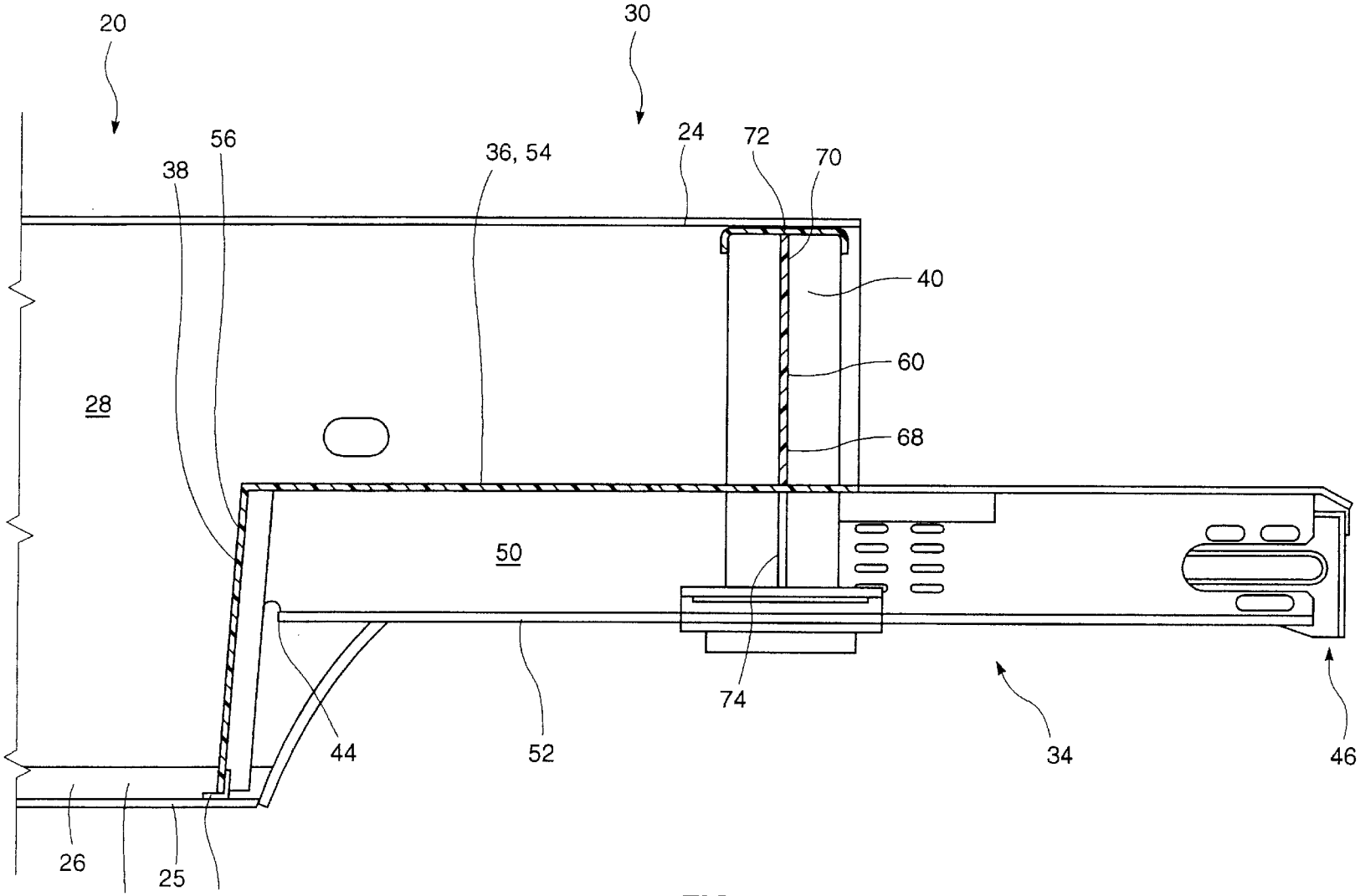
Figure 4:
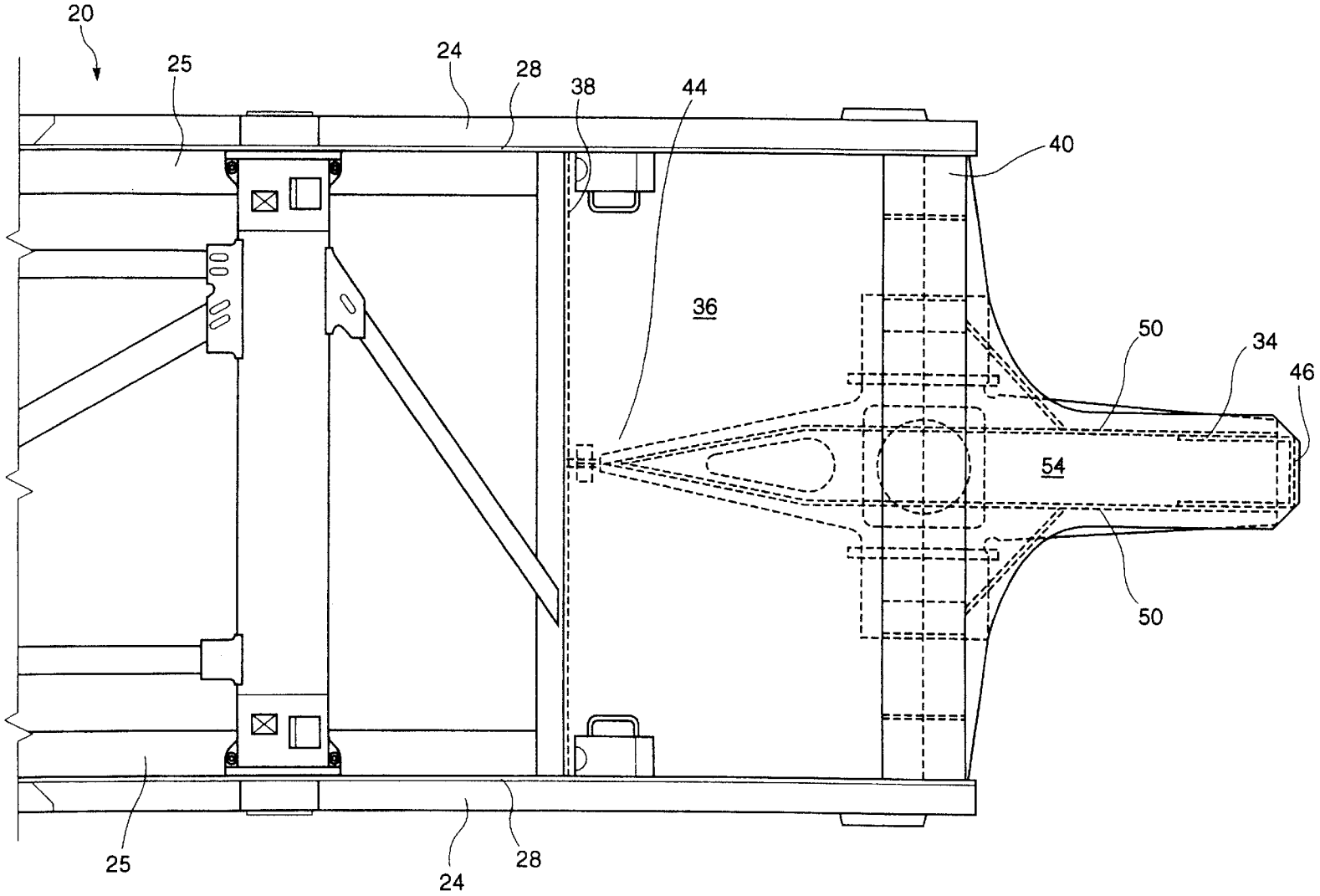
FIG. 4 is a top plan view of the railroad car as depicted in FIG. 3-1.
Figure 5:
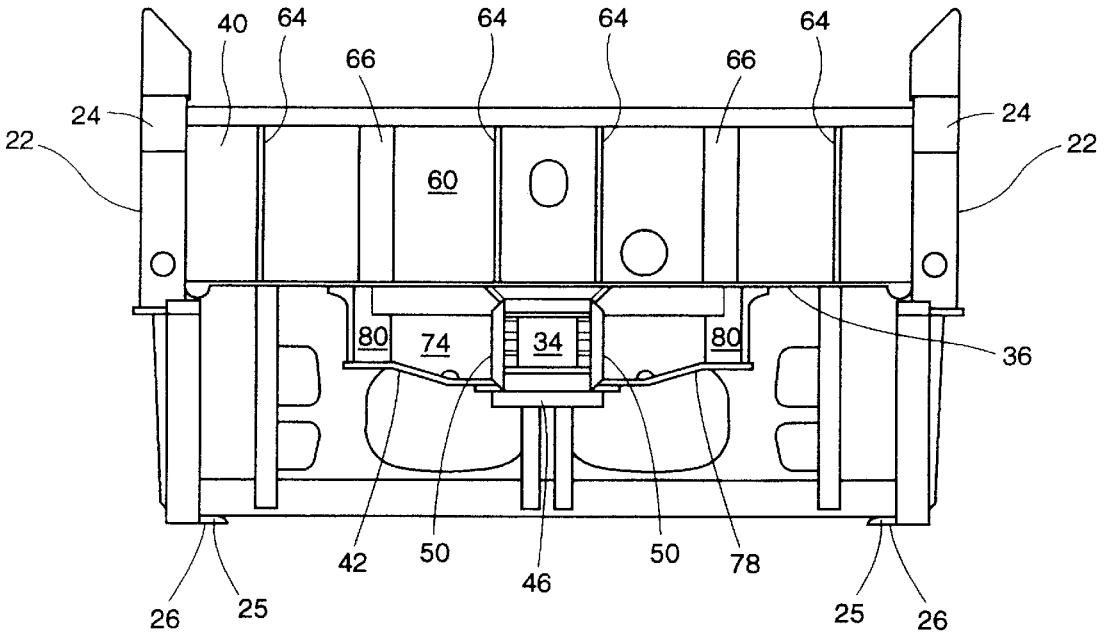
FIG. 5 is an end elevational view of the railroad car as depicted in FIG. 3-1.

The end structure 30 according to the present invention is more particularly illustrated in FIGS. 2 to 4. Both end structures 30 of the car are identical. For simplicity, only one end structure 30 is illustrated. Each end structure 30 comprises a stub centre sill 34 (best shown in FIGS. 3-1 and 3-2), a shear plate 36 (FIGS. 3-2 and 4), an inboard bulkhead 38 (shown in FIG. 1 and in FIG. 3-2) and first and second laterally extending structural members (FIG. 5). The first and second laterally extending structural members are an upper bolster 40 and a lower bolster 42 respectively.

The stub centre sill 34 runs beneath the longitudinal centre line of the car 20 and extends from the bulkhead 38 to a point outboard of the car body 20 (FIGS. 3-B and 4). A reader skilled in the art will readily appreciate that the stub centre sill 34 may be constructed in accordance with standard practice. However, in the preferred embodiment, stub centre sill 34 is tapered inwardly towards its longitudinal centre line at its inboard end 44 (FIG. 4 in dotted lines). The outboard end 46 of stub centre sill 34 houses a conventional coupler 48 (FIG. 2) for coupling the car 20 to another car to form a train. In the preferred embodiment, the stub centre sill 34 includes a pair of spaced apart vertical side plates 50 (FIGS. 3-B, 4 and 5), a bottom plate 52 (FIG. 3-B), and a top plate 54 (FIGS. 3-2 and 4). In the preferred embodiment, the shear plate 36 is the top plate 54 of the stub centre sill 34.

As is best shown in FIG. 1, the shear plate 36 is substantially planar and extends laterally between the side structures 22, to connect to the respective side walls 28 thereof. As shown in FIG. 4, the outboard peripheral edges of the shear plate 36 define overhanging extensions that project longitudinally beyond the outer edge of the upper bolster 40 and laterally beyond the stub centre sill side plates 50. Referring to FIG. 3-B, the shear plate 36 has an inboard terminal edge from which an upper terminal edge of the bulkhead 38 depends. Shear plate 36 is integral with the bulkhead 38 in the preferred embodiment. In the preferred embodiment, the bulkhead 38 is a continuation of the shear plate 36, wherein the inboard lateral edge of the shear plate 36 extends rearwardly and downwardly to merge with the upper portion 56 of the bulkhead 38.

The bulkhead 38 extends laterally between sidewalls 28 and is joined thereto. The bulkhead 38 extends downwardly from its upper portion 56 to a point just slightly below the top edge of the bottom side chord 26 (FIG. 3-B). In the preferred embodiment, the bulkhead 38 is oriented at a slight angle away from the vertical (FIG. 3-2) to provide some additional clearance between the bulkhead 38 and the ends of containers located in the well portion of the car 20 (not shown). Welded along the lower lateral edge of the bulkhead 38 is a transverse angle member 58 (FIG. 3-2). The transverse angle member 58 is connected at each end to a bottom side chord 26 of the car 20.

The upper bolster 40 extends laterally for the width of the car 20 (FIG. 5). In the preferred embodiment, the upper bolster 40 comprises a single laterally extending vertical web 60 (FIGS. 3-B and 5) and a plurality of reinforcing members. In the preferred embodiment, the reinforcing members are vertically disposed spaced apart plates 64 and substantially U-shaped pressings 66 which are joined to both inbo ard and outboard faces of the vertical web 60 such that the upper bolster 40 is symmetric about the vertical web 60. Vertical web 60 extends laterally between the sidewalls 28 of the car 20. The lower lateral edge 68 of the vertical web 60 is joined to the shear plate 36 (FIG. 3-2). The upper lateral edge 70 of the vertical web 60 is joined to a top flange 72, which is joined at its ends to top side chords 24. The vertical edges of vertical member 60 are joined to the sidewalls 28 of car 20 (FIG. 5).

Unlike upper bolster 40, lower bolster 42 is a stub bolster in that it does not extend the entire width of the car 20 (FIG. 5). Lower bolster 42 includes a vertical web 74 which is substantially co-planar with vertical web 60 of the upper bolster 40. Joined to the lower edge of the lower bolster 42 is a flange 78 which is transverse to, and connected to an intermediate section of the stub centre sill 34. Vertical substantially U-shaped pressings 80 are joined to both the front and rear faces of the vertical web 74 of the lower bolster 42 and are aligned with vertical pressings 66 of the upper bolster 40 (FIG. 5). Vertical pressings 80 are joined at their bottom edges to the flange 78 and at their top edges to shear plate 36.

As stated, each side structure 22 comprises a top side chord 24, a bottom side chord 26 and a side wall 28. Top side chord 24 and bottom side chord 26 are spaced apart. Top side chord 24 and bottom side chord 26 may be constructed in accordance with standard practice. However, in the preferred embodiment, top side chord 24 is a hollow, straight line structural tube of rectangular cross-section (FIG. 5) and bottom side chord 26 is a straightline angle member having an inwardly extending horizontal leg 25 (FIGS. 3-2 and 5) and an upwardly extending vertical leg 27 (shown in FIG. 3-2).

Referring to FIG. 3-A, the top side chord 24 has terminal ends 24A. Bottom side chord 26 has terminal ends 26A. Top side chord 24 is longer than bottom side chord 10 26. However, as the reader will understand from FIG. 1, the longitudinal midpoints of the top side chord 24 and bottom side chord 26 are vertically aligned. As is best illustrated in FIGS. 1 and 3-A at each end of the car 20, the terminal end 24A of the top side chord 24 extends longitudinally beyond the terminal end 26A of the bottom side chord 26. Thus, at one end of the car 20, in an area of the end structure outboard of the terminal end 26A, the top side chord 24 overhangs the bottom side chord 26 by a distance substantially equal to one half of the difference in length between the top side chord 24 and the bottom side chord 26.

As illustrated in FIG. 4 for the preferred embodiment of the invention, the side walls 28 are shown respectively attached to the inner vertical faces of each top chord 24 along the length of the railcar. FIG. 4 depicts the side wall as being a planar, single web which is vertically disposed.

The portion of the side wall 28 generally adjacent to the end structure (the "end portion of the side wall") is shown in FIG. 3-A as 100. The end portion of the sidewall 100 also consists of a planar, single web in the area of the end structure outboard of the terminal end 26A of the bottom side chord 26 and inboard of the terminal end 24A of the top side chord 24. The end portion of the sidewall 100 extends substantially vertically between the top side chord 24 and the bottom side chord 26. The end portion of the sidewall 100 has a top edge 102, a front edge 104, and a bottom edge 106. The bottom edge 106 comprises three portions, namely an inboard straightedge portion 106*a*, an intermediate curved portion 106*b*, and an outboard straightedge portion 106*c*.

The inboard straightedge portion 106*a* is joined along its length to an inward surface of the vertical leg 27 of the bottom side chord 26. The inboard straightedge portion has an outboard terminal end adjacent the terminal end 26A of the bottom side chord. The intermediate curved portion 106*b* extends upwardly from the outboard terminal end of inboard straightedge portion 106*a* and merges with the inboard end of the outboard straightedge portion 106*c*. As viewed in FIG 2 and 3-1, the intermediate curved portion 106*b* defines a continuous curve having a positive slope of constantly decreasing value when measured from the inboard straightedge portion 106*a* to the outboard straightedge portion 106*c*. Those skilled in this art will readily appreciate that when viewed in any direction, the continuous curve of intermediate curved portion 106(*b*) has a slope of constantly decreasing absolute value.

A unitary or one-piece curved flange 112 is connected at its inboard end to the terminal end 26A of the bottom side chord 26 and to the intermediate curved portion 106*b* and outboard straightedge portion 106*c* of the bottom edge 106 of the end portion of the sidewall 100.

Whereas the flange 112 is of a solid rectangular cross-section in the preferred embodiment, those skilled in the art will appreciate that other embodiment such as square, oval or triangle are also available. The connection of the curved flange 112 to the bottom edge of the sidewall 100 may have a variety of cross-sectional profiles, such as an inverted "T" or an "L". In the preferred embodiment the connection of the curved flange 112 to the sidewall 100 has a cross-section resembling an inverted "T".

In the preferred embodiment, curved flange 112 is curved such that it rises several inches above the top surface of the top side frame 113 of the truck 32, as shown in FIG. 2. Curved flange 112 is designed to expose the truck 32, to facilitate access by a user to the wheels and brake shoes of the truck 32 from the side thereof. In addition, the user can inspect the truck 32 and access it from the side which facilitates maintenance and repair thereof. Furthermore, because the flange 112 is continuous in curvature and does not introduce stress risers associated with geometric discontinuity, it is expected to enhance the fatigue resistance of the flange and the end portion of the sidewall 100 which is immediately adjacent the flange 112.

As is best shown in FIG. 2, the side structures 22 adjacent the end structures 30 are reinforced by a first vertically disposed side member 120 and a second vertically disposed side member 122. The first side member 120 is located outboard of second side member 122. The first side member 120 is a U-pressing wherein the free terminal longitudinal edges of the U-pressing are attached to the end portion of the sidewall 100, with the upper edge being attached to the underside of the top side chord 24. The U-pressing is profiled to sit atop the curved flange 112. The first side member 120 further comprises a reinforced opening 124 suitable for the installation of a conventional towing cable hook (not shown). The first side member 120 has a bottom plate 126 which is integral with the curved bottom flange 112, but which extends laterally outwardly of the curved flange 112. Bottom plate 126 has an opening (not shown) suitable for the installation of a conventional lifting cable hook (also not shown).

Referring to FIGS. 2 and 3-A, the second side member 122 comprises a web 128 (shown in FIG. 3-1 in dotted lines) which extends laterally outwardly of the end portion of the sidewall 100. Web 128 is joined at its inside longitudinal edge to end portion of the sidewall 100 and at its top and bottom edges to the underside of top side chord 24 and to the vertical leg 27 of bottom side chord 26, respectively. Web 128 and the bulkhead 38 are substantially coplanar with one another. Joined to the outward longitudinal edge of the web 128 and substantially parallel to the end portion of the sidewall 100 is a generally vertically disposed tapered flange 130 (FIGS. 2 and 3). The upper terminal end of the tapered flange 130 is connected to the top side chord 24. Tapered flange 130 is wider at its upper end than its lower end. The second side member 122 is designed to act as a wide flanged beam wherein the end portion of the sidewall 100 is the first flange of the beam, the web 128 is the web of the beam and the tapered flange 130 is the second flange of the beam.

The second side member 122 is designed to enhance the buckling resistance of the top side chord 24 under compressive loads by reducing the unsupported length of the top side chord 24. In addition, the second side member 122 is expected to increase the torsional stiffness of the top side chord 24 at the bulkhead 38.

The foregoing detailed description has been given for clarity of understanding only and no unnecessary limitation should be understood therefrom, as various modifications of detail to the present invention will be apparent to those skilled in the art, all of which would come within its spirit and scope.

I claim:

1. An end structure for a railroad freight car having longitudinally extending and spaced apart side structures, each of said side structures providing top and bottom longitudinally disposed structural members which extend the length of the railroad freight car substantially from end to end thereof, the structural members being spaced apart and connecting to the end structure, each of the top and bottom structural members having a terminal end portion thereof, the bottom structural member being shorter in length than the top structural member to define an overhanging relationship between said top and bottom structural members in an area of the end structure outboard of the terminal end portion of the bottom structural member, the end structure comprising: a planar sidewall extending substantially vertically between said top and bottom structural members, the sidewall having a top edge joined to the top structural member and a bottom edge, the bottom edge consisting of an inboard straightedge portion, an intermediate curved portion and an outboard straightedge portion, the inboard straightedge portion being joined along the length thereof to the bottom structural member, the intermediate curved portion extending upwardly from the inboard straightedge portion adjacent the terminal end portion of the bottom structural member and merging with said outboard straightedge portion, the intermediate curved portion defining a curved edge having a slope of constantly decreasing absolute value when measured from the inboard straightedge portion to the outboard straightedge portion, the end structure further comprising a one-piece curved flange connected to the terminal end of the bottom structural member and to the intermediate curved portion of the bottom edge of the planar sidewall along the entire length thereof, and wherein the planar sidewall consists of a single web in the said area of the end structure outboard of the terminal end portion of the bottom structural member and inboard of the terminal end portion of the top structural member.

2. The end structure according to claim 1, wherein the railroad freight car provides a well portion for receiving a cargo container.

3. The end structure according to claim 2, wherein the one-piece curved flange is also connected to the outboard straightedge portion of the bottom edge of the planar sidewall along the entire length thereof.

4. The end structure according to claim 3, wherein the connection of the flange to the bottom edge of the planar sidewall, in cross-section, has a substantially inverted T-shaped profile.

5. The end structure according to claim 2 further comprising an inboard bulkhead extending between the side structures and connected to the respective sidewalls thereof.

6. The end structure according to claim 5 further comprising a transversely disposed structural member connected at each end to the top structural members of the side structures.

7. The end structure according to claim 6 wherein the transversely disposed structural member is an upper bolster.

8. The end structure according to claim 7 further comprising a horizontally disposed shear plate, the shear plate having an upper surface to which the upper bolster is attached, an opposed lower surface, and an inboard terminal edge from which the bulkhead depends.

9. The end structure according to claim 8 wherein the shear plate and bulkhead each extend between the side structures to connect to the respective sidewalls thereof.

10. The end structure according to claim 9 further comprising a lower stub bolster connected to the lower surface of the shear plate.

11. The end structure according to claim 10 wherein the side structure provides a generally vertically disposed web located adjacent each bulkhead and being substantially co-planar therewith, the web being connected to the sidewall along an inwardly facing longitudinal edge of the web.

12. The end structure according to claim 11 wherein each side structure further provides a generally vertically disposed flange member connected to the outwardly facing longitudinal edge of the web, the flange member having one terminal end thereof connected to the top structural member of the side structure.

13. The end structure according to claim 12 wherein the top and bottom structural members of the side structures are elongate straightline chords.

* * * * *